United States Patent [19]

Reader

[11] Patent Number: 4,458,513

[45] Date of Patent: Jul. 10, 1984

[54] LOCK AND KEY SET AND KEY THEREFOR

[75] Inventor: Michael W. Reader, Hornchurch, England

[73] Assignee: Ford Motor Company, Dearborn, Mich.

[21] Appl. No.: 353,753

[22] Filed: Mar. 1, 1982

[30] Foreign Application Priority Data

Mar. 14, 1981 [GB] United Kingdom ..... 8108093

[51] Int. Cl.[3] ..... E05B 29/02; E05B 19/06

[52] U.S. Cl. ..... 70/364 R; 70/409

[58] Field of Search ..... 70/364 R, 409, 337, 70/340, 377, 364 A

[56] References Cited

U.S. PATENT DOCUMENTS 4,107,963 8/1978 Yorio ..... 70/337

4,232,539 11/1980 Lo ..... 70/409

FOREIGN PATENT DOCUMENTS 1462932 11/1966 France ..... 70/409

737547 9/1955 United Kingdom ..... 70/304 R

*Primary Examiner*—Robert L. Wolfe

*Attorney, Agent, or Firm*—Daniel M. Stock; Clifford L. Sadler

[57] ABSTRACT

A lock and key set comprises two cylinder locks (1,2) each having a cylinder (3,3'), a barrel (4,4') rotatable in the cylinder, and a set of tumblers (9,9') radially movable in the cylinder into and out of engagement with the cylinder, and a key (20) having a bit (21) which can be inserted into the barrels of both locks and provided with two sets (23,24) of cam surfaces (22). The sets of tumblers (9,9') in each lock are movable by a respective one of the sets of cam surfaces in response to rotation of the key bit in clockwise and anticlockwise directions, so that when the two locks are incorporated in doors on opposite sides of a vehicle, they are actuated with opposite movements.

4 Claims, 2 Drawing Figures

LOCK AND KEY SET AND KEY THEREFOR

DESCRIPTION

Figure 1:
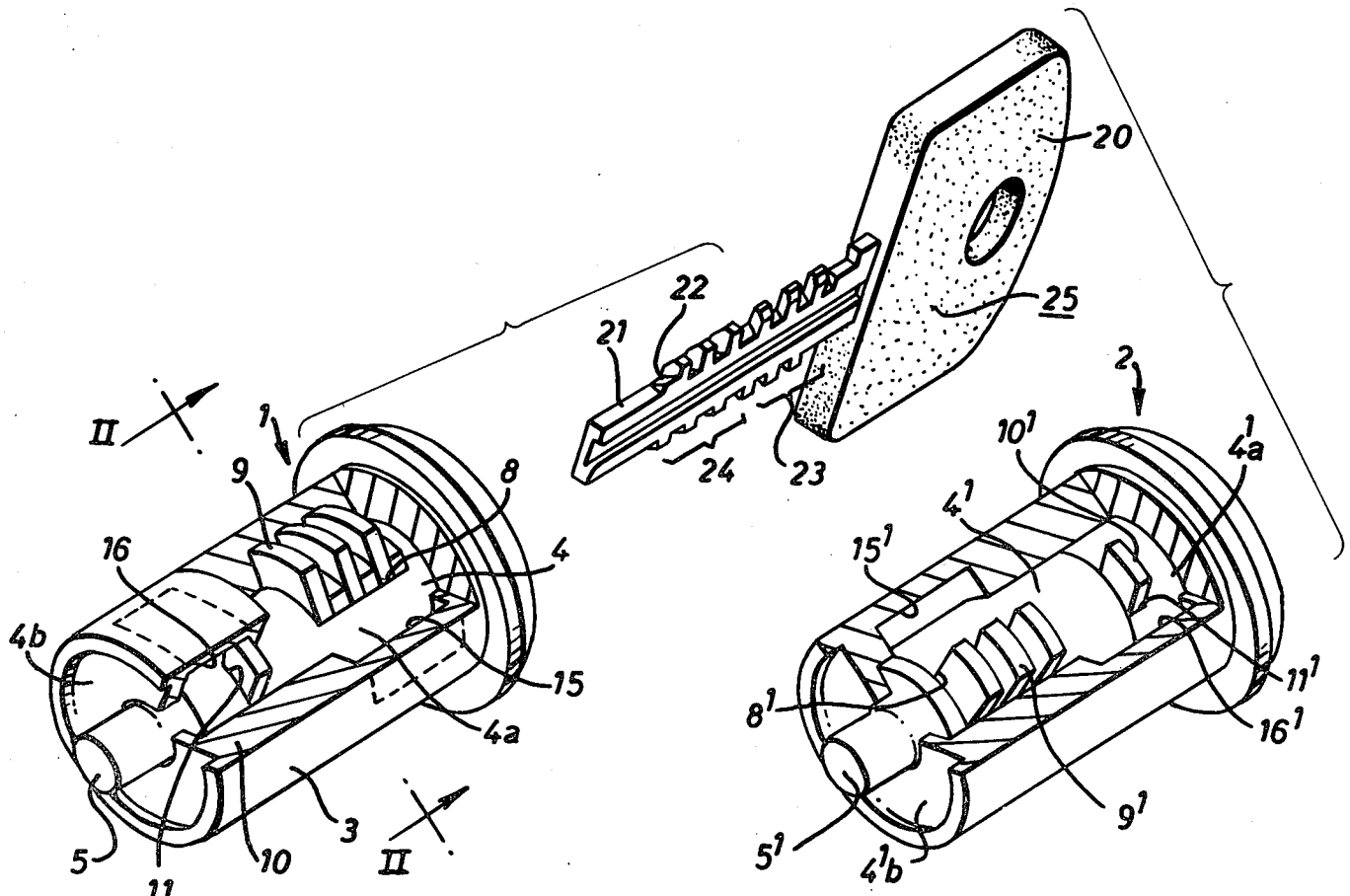

This invention relates to lock and key sets and keys therefor.

One known cylinder lock comprises a cylinder, a barrel rotatable in the cylinder in both directions, an axial aperture in the barrel for receiving a key bit, and a set of tumblers mounted in the barrel for radial movement into and out of engagement with the cylinder. Such locks are operated by a key which has a bit provided with cam surfaces which engage the tumblers to effect radial movement thereof in response to a rotational movement of the bit within the barrel.

Motor vehicles include lock and key sets comprising at least two cylinder locks and a key which is capable of operating both locks. Where the locks are positioned in doors on opposite sides of the vehicle it is desirable that the unlocking actions should also be opposite.

According to the present invention, there is provided a lock and key set comprising two cylinder locks each having a cylinder, a barrel rotatable in the cylinder, an axial passage in the barrel for receiving a key bit, and a set of tumblers mounted in the barrel for radial movement into and out of engagement with the cylinder, and a key having a bit provided with cam surfaces for engaging the tumblers of each cylinder lock to effect radial movement thereof in response to a rotational movement of the bit in the barrel, characterised in that the cam surfaces comprise two sets, and in that the sets of tumblers in both locks are each movable by a respective one of the sets of cam surfaces in response to rotation of the key bit in clockwise and anti-clockwise directions respectively.

The invention also includes a key for two cylinder locks and comprising an axially extending bit for insertion into a rotatable barrel of the lock, and cam surfaces on the bit for engaging a set of tumblers mounted on the barrel, whereby rotation of the bit about its axis relative to the barrel produces radial movement of the tumblers, characterised in that a first set of the cam surfaces are adapted to produce the radial movement of the set of tumblers in a first lock upon rotation in one direction, and a second set of the cam surfaces are adapted to produce the radial movement of the set of tumblers in a second lock upon rotation in the opposite direction.

By providing two sets of cam surfaces on the key bit and arranging the sets of tumblers in the two cylinder locks to be operated by respective ones of the sets of cam surfaces in response to rotation of the key in respective opposite directions, the same key can be used to operate both locks, and, when the locks are installed in a motor vehicle on opposite sides, they are operable with opposite locking actions.

Although the tumblers of each set could be accommodated in individual pockets in the barrels, manufacture of the locks can be simplified by disposing the tumblers of each set alongside each other in a single pocket in the barrel, and positioning the pocket of one lock towards one end of the barrel and the pocket of the other lock towards the other end of the barrel.

The corresponding key would then have the first set of cam surfaces towards one end of the bit, and the other set of cam surfaces towards the other end of the bit.

If it is desired that the lock should be secure against locking in addition to unlocking, each barrel may carry one or more further tumblers mounted for radial movement into and out of engagement with the cylinder in response to rotation of the key bit in the opposite direction to that in response to which the set of tumblers on that barrel is movable.

In order to accommodate the initial rotation of the key in either direction, the barrel for such a lock is preferably composed of two coaxial parts, one of which carries the set of tumblers and the other of which carries the or each further tumbler. The two parts of the barrel are mounted for limited relative rotation by an amount sufficient to prevent rotation of one barrel with the bit relative to the other whilst the tumbler or tumblers in the other barrel are retracted.

Figure 2:
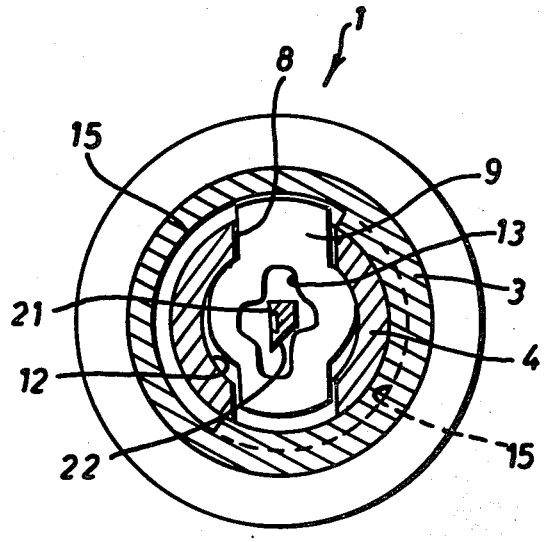

A preferred embodiment of the invention will now be described, by way of example only, with reference to the drawings in which:

FIG. 1 is a perspective view of a lock and key set in accordance with the invention, with the lock partially broken away, and FIG. 2 is a cross-section taken along line II—II of FIG. 1.

Referring to the drawings, a lock and key set for a motor vehicle comprises a first and second cylinder locks 1, 2 which, in use, are each connected by a linkage (not shown) to a respective latch mechanism in the left and right-hand doors of a motor vehicle.

The first cylinder lock 1 comprises a cylinder 3, which is fixed to the door, and a barrel 4 rotatable about the axis of the cylinder 3 in both directions from the central position illustrated. One end of the band 4 carries a drive spindle 5 by means of which the cylinder lock is connected to the latch mechanism. Rotation in the anticlockwise direction followed by a return to the central position unlocks the latch mechanism; rotation in the clockwise direction followed by a return to the central position locks the latch mechanism.

The barrel 4 is formed in two coaxial cylindrical parts **4*a*, 4*b* which are coupled together by a lost motion connection (not shown), such as a circumferential slot and peg in the abutting radial faces of the cylindrical parts 4*a*, 4*b*, which permits a limited relative rotation of the parts 4*a*, 4*b*** through, for example, an angle of 30° in either direction from the central position illustrated.

A first part, **4*a*, of the barrel 4 is provided with a radial aperture or pocket 8 which extends through the barrel and in which is positioned a set of six tumblers 9. A further tumbler 10 is positioned in a further pocket 11 which extends only to the centre of the second part 4*b* of the barrel. As illustrated in FIG. 2, the pockets 8 and 11 communicate with a central axial passage 12 in the barrel 4, and each tumbler includes a central aperture 13 which registers with the passage 12. The tumblers 9 and 10 are slidable radially in their pockets 8 and 11 into engagement with grooves on the internal surface of the cylinder 3. Two such grooves 15 are provided at one end of the cylinder 3 diametrically opposite each other for the set of tumblers 9, three tumblers 9 being movable into engagement with each groove 15. These grooves allow the barrel 4 to be rotated through 90° in an anticlockwise direction from the position illustrated when tumblers 9 are in their radially extended positions. A single groove 16 is provided for engagement by the further tumbler 10. This groove allows the barrel 4 to be rotated through 90° in a clockwise direction from the position illustrated when the further tumbler 10** is in its radially extended position.

The second cylinder lock 2 is of similar construction to the first cylinder lock, and similar parts have been identified by like, primed, reference numerals. The main differences between the two locks are that the set of tumblers 9' is accommodated in a pocket 8' towards the opposite end of the second part 4'*b* of the barrel 4' as compared with the position of the pocket 9 in the barrel 4 of the first lock, the further tumbler 10' being positioned in a pocket 11' in the first part 4'*a* of the barrel. Additionally, the grooves 15' and 16' extend in the opposite directions as compared with those of the first lock, accommodating a 90° anticlockwise movement of the set of tumblers 9' and a 90° clockwise movement of the further tumbler 10'.

Both locks are operable by a single key 20 which has a bit 21 which can be inserted into the passages 12, 12' within the barrels 4, 4' through the apertures in the tumblers 9, 9', 10, 10'. The bit 21 is formed with twelve cam surfaces 22. The cam surfaces 22 are divided into two sets 23, 24. The first set 23 of cam surfaces positioned towards the handle 25 of the key 20 register with the apertures in the set of tumblers 9 in the barrel 4 of the first cylinder lock 1, and the second set 24 of cam surfaces register with the apertures in the set of tumblers 9' in the barrel 4' of the second cylinder lock 2. One of the cam surfaces 22 in the second set registers with the further tumbler 10 in the first cylinder lock, and one of the cam surfaces in the first set registers with the further tumbler 10' in the second cylinder lock 2.

The cam surfaces 22 and apertures in the tumblers 9, 10 with which they register are so shaped that when the bit 21 is rotated through 30° anticlockwise relative to the barrel 4 from the central position illustrated, are moved radially inwardly to lie flush with the barrel 4. However, the further tumbler 9 remains in its extended position. Consequently the second part 4*b* of the barrel in which it is mounted moves 30° anticlockwise relative to the first part of the barrel 4*a*, taking up the lost motion in the connection between the two parts of the barrel. A further 60° anticlockwise movement of the key then produces a combined movement of the two parts to the barrel until the further tumbler 11 engages the end of the groove 16 in the cylinder 3. During this sequence of operations, the operating linkage attached to the spindle 5 is activated to unlock the latch mechanism.

To remove the key from the lock, the key is rotated back through 90° into the position illustrated in FIG. 1. The linkage between the spindle 5 and the latch mechanism incorporates a conventional lost motion connection to prevent the latch mechanism from locking.

In order to lock the latch mechanism, the key is rotated 90° clockwise relative to the cylinder 3. The first 30° of movement from the central position causes the further tumbler 11 to retract in its pocket so that it lies flush with the surface of the second part 4*b* of the barrel. The set of tumblers 9 however, remains in their extended positions, so that the first part 4*a* of the barrel rotates with the key, taking up the lost motion in the connection between the two parts of the barrel. A further 60° clockwise movement of the key produces a combined clockwise movement of the two parts of the barrel 4 until the set of tumblers 9 engages the ends of the grooves 15 in the cylinder 3. The clockwise movement of the spindle 5 unlocks the latch mechanism. The key can be removed from the lock after rotating the barrel 4 back to the central position.

The operation of the second cylinder lock 2 is similar to that of the first cylinder lock, except that an anticlockwise movement of the barrel 4' produces a locking action, and an anticlockwise movement produces an unlocking action. Hence, since the two cylinder locks are positioned on opposite doors of the motor vehicle, the two latch mechanisms are operated with opposite actions using the same key.

It will be noted that in both locks, the unlocking movement requires the actuation of six tumblers whereas the locking movement requires the actuation of only a single tumbler. The locking movement is therefore less difficult to produce without the key 20 than the unlocking movement. This is of course, acceptable because the purpose of the lock is to prevent actuation of the latch mechanism when locked. Indeed, in a simpler construction the further tumblers 10, 10' could be omitted completely so that the locking movement is produced simply by rotation of the barrel 4.

I claim:

1. A lock and key set comprising two cylinder locks each having a cylinder, a barrel rotatable in the cylinder, an axial passage in the barrel for receiving a key bit, and a set of tumblers mounted in the barrel for radial movement into and out of engagement with the cylinder; and a key having a bit provided with cam surfaces for engaging the tumblers of each cylinder lock to effect radial movement thereof in response to a rotational movement of the bit in the barrel; characterised in that the cam surfaces comprise two sets, and in that the sets of tumblers in both locks are each movable by a respective one of the sets of cam surfaces in response to rotation of the key bit in clockwise and anticlockwise directions respectively.

2. A lock and key set according to claim 1 wherein the tumblers in each set are disposed alongside each other in a pocket in the barrel, the pocket in one barrel lying towards one end of the barrel, the pocket in the other barrel lying towards the other end of the barrel.

3. A lock and key set according to claim 1 wherein each barrel carries one or more further tumblers mounted radial movement into and out of engagement with the cylinder in response to rotation of the key bit in the opposite direction to that in response to which the said set of tumblers on that barrel is movable.

4. A lock and key set according to claim 3 wherein each barrel comprises two coaxial parts, one part carrying the set of tumblers, the other part carrying the or each further tumbler, the two parts of the barrel being mounted for limited relative rotation by an amount sufficient to permit rotation of one barrel with the bit relative to the other barrel whilst the tumbler or tumblers in the other barrel are retracted.

* * * * *